United States Patent [19]

Amedeo et al.

[11] Patent Number: 4,782,882

[45] Date of Patent: Nov. 8, 1988

[54] VENETIAN BLIND MOUNTING BRACKET

[76] Inventors: Joseph Amedeo, 300 D, Joe Parker Rd., Lakewood, N.J. 08701; Joseph Moscato, Jr., 97 Heratige Dr., Howell, N.J. 07731

[21] Appl. No.: 124,042

[22] Filed: Nov. 23, 1987

[51] Int. Cl.[4] ..... E06B 9/38

[52] U.S. Cl. ..... 160/178.1; 211/105.1; 403/374; 403/409.1; 248/251; 248/200.1

[58] Field of Search ..... 160/178.1; 211/145.1; 403/374, 409.1; 248/200.1, 231.3, 264, 288.5, 316.2, 57, 251, 231.2, 224.3

[56] References Cited

U.S. PATENT DOCUMENTS 2,207,517 7/1940 Ganke ..... 248/264

4,381,578 5/1983 Glejf ..... 403/374 X

*Primary Examiner*—Ramon S. Britts

*Assistant Examiner*—Blair M. Johnson

*Attorney, Agent, or Firm*—Charles F. Gunderson

[57] ABSTRACT

A supplementary cap, or mounting bracket, is provided for one or both ends of the head rail of a venetian blind. The mounting bracket or brackets must fit snugly, but slideably over the ends of the head rails of the venetian blind, and be strong enough to support the venetian blind when they are secured against the insides of the window frame jambs. Each mounting bracket includes a lever arm that can be turned to rotate a cam, within the bracket, that will urge a spacer against the adjacent end of the head rail and force the outer end of the mounting bracket against the inside of the adjacent window frame jamb. By selecting an appropriate length of head rail, mounting brackets, and spacers, the venetian blind unit should fit between the insides of the window frame jambs, and turning the lever arms will force the ends of the mounting brackets against the jambs to support the venetian blind, without screws or fasteners, securely, but removably, for adjusting or cleaning.

11 Claims, 1 Drawing Sheet

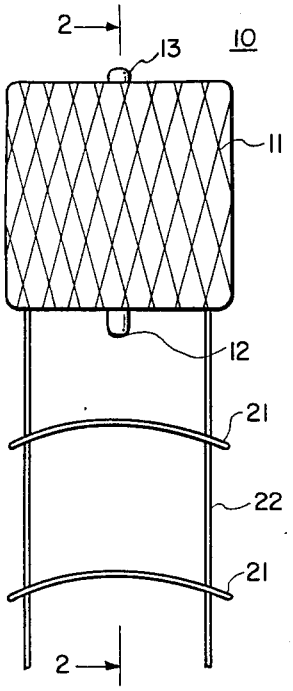
FIG. 1
FIG. 2
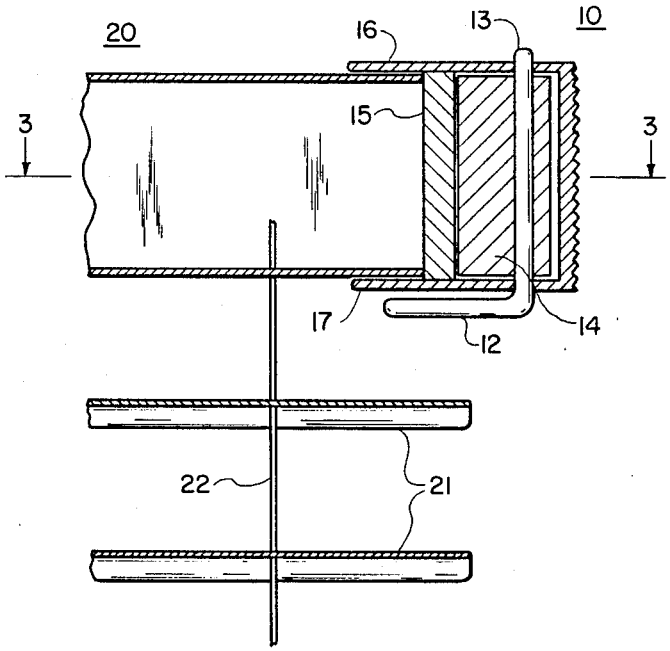
FIG. 3
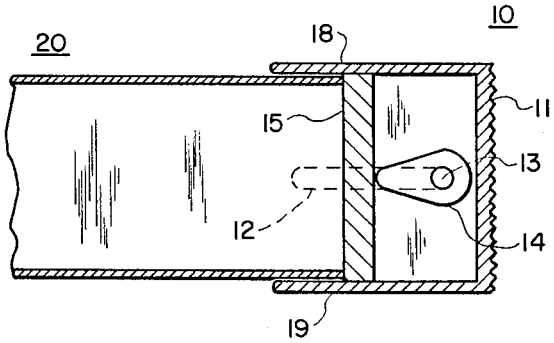
FIG. 4
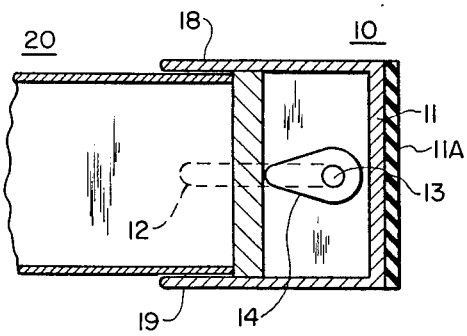
FIG. 5
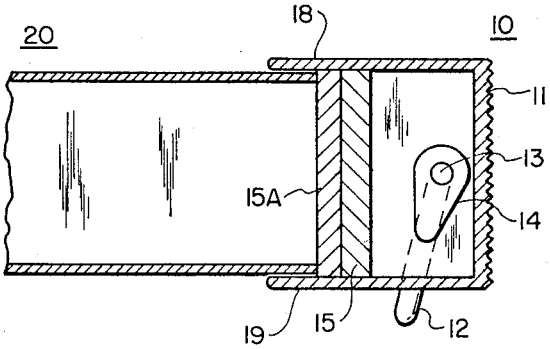

VENETIAN BLIND MOUNTING BRACKET

BACKGROUND OF THE INVENTION

Venetian blinds are, almost invariably, supported by a head rail that contains the mechanisms that support the strings that control the blinds. Horizontal blinds must have strings that can raise or lower the slats or control their angle. Vertical blinds have mechanisms for drawing the slats to one side, or rotating them one way or the other.

Mounting brackets, on either end, are usually provided to be attached to the top of the casement, on the inside or the outside. These are usually open brackets that must be permanently fastened to the frames or casement, but can be opened to permit the head rail to be mounted, or removed at any time for cleaning or adjustment if necessary.

In many cases, where the casements are deep enough, and for esthetic considerations, these mounting brackets are fitted inside the casements so that the venetian blinds do not extend out into the room, or interfere with curtains or drapes that may be planned for the window openings.

In any case, these mounting brackets must be physically secured to the window casement, with screws or other fasteners that inevitably puncture the casement, and leave permanent scars, however trivial. If the alignment is not perfect, additional holes must be drilled to get the blinds to hang right.

All of this takes time and skill for the mounting and the correct alignment of the brackets, which is not necessarily within the capability of the average home owner, or head of a household, male or female.

It is therefore an object of this invention to provide a replacement bracket for mounting venetian blinds within a window frame that can be fitted onto the ends of the head rail of the the blinds for friction fastening of the head rail and blinds within the window casement or frames without screws or nails or other things that would physically change, or damage, the sides of the window casements. These completely replace the conventional mountings, that must be nailed or screwed to the sides of the frames. These can be very quickly mounted with minimal skill; and that can be as easily and quickly dismounted for realignment, cleaning, or replacement, if necessary.

It is a further object of this invention to provide a simple mounting bracket for venetian blinds that permits the blinds to be mounted in minutes, without drills or screws or careful measurements, or removed or realigned or replaced as easily, without any damage at all to the window frames. These, and other objects will become apparent in the following specification, and drawings.

SUMMARY OF THE INVENTION

Instead of a fixed bracket, permanently screw or fastened to the lintel or jambs of a window frame to support a venetian blind, a supplementary cap or mounting bracket is provided that can fit over one or both of the ends of the head rail of the venetian blind support to fit within the window frame, and be pressed against the window frame jambs, by leverage, tightly enough to hold the venetian blind in place. The levers can be easily turned to mount or dismount the blinds, or adjust the angle of the blinds. The mounting brackets include spacers to compensate for minor differences in the distances between the insides of the frames of a given window casement. Knurled ends, or rubber or plastic end pieces may be provided on the outsides of the mounting brackets to insure a more positive contact with, and more friction against the window frame, without physical damage to the frame.

BRIEF DESCRIPTION OF THE DRAWINGS

FIG. 1 shows an end view of a venetian blind with a mounting bracket in accordance with this invention;

FIG. 2 shows a cross section of the blind and bracket of FIG. 1 along the lines 2—2 of FIG. 1;

FIG. 3 shows a top view, in cross section along the lines 3—3 of FIG. 2, with the lever arm and cam engaging a spacer; and FIG. 4 shows the same view, as in FIG. 3, with a layer of high-friction material on the end of the bracket; and FIG. 5 shows the same top view, in cross section, with an additional spacer, and the lever arm and cam disengaged.

DETAILED DESCRIPTION OF THE DRAWINGS

Referring now more particularly to FIG. 1, an end view is shown of a bracket 10, that supports a venetian blind, with a scored surface 11 to provide a tight grip on the sides, or jambs, of a window frame. A handle or lever arm 12 that controls the device is seen just under the bracket. This will be more clearly seen in FIGS. 2, 3, and 4. Venetian blind slats, such as 21, and cords, such as 22, of conventional types, to control the slats, are also seen.

FIG. 2 shows a cross section of the venetian blind and mounting bracket of FIG. 1 along the lines 2—2 of FIG. 1. This shows, more clearly, the lever arm 12 connected to and controlling a shaft 13 that turns a cam 14 that urges spacer 15 against the head rail of the blind, and the friction surface, that will be forced against the inside, or jamb, of a window casement—that is not essential to the invention, and is not shown here. The shaft 13 extends through a top portion 16 and a bottom portion 17 of the mounting bracket. In all of these figures, similar elements are similarly numbered. FIG. 3 is a top view of the venetian blind and the mounting bracket 10 in cross section along the lines 3—3 of FIG. 2. This shows, quite clearly, the shaft 13, and cam 14 controlled by the lever arm 12, that can force the end 11 of the mounting bracket tightly against the side of a window frame, or the like, not shown. The spacer 15, again, pushes against the head rail of the venetian blind, that is further contained by an outside portion 18, and an inside portion 19 of the bracket.

FIG. 4 shows the same view as FIG. 3, again in cross section, with the addition of a layer 11A of a resilient material that will compress when forced tightly against the side of the frame, to conform to the surface of the frame and improve the strength of the mounting. This layer may also include an adhesive to further secure the end of the bracket to the window frame.

FIG. 5 shows the same view as FIG. 3, again in cross section, but with the lever arm 12 rotated to cause the shaft 13 to disengage the cam 14 for removal or readjustment of the mounting bracket and venetian blind. This also shows an additional spacer 15A, which may be necessary to apply more pressure against the insides of the jambs of the casements, or to compensate for slightly wider openings.

These spacers such as 15 and 15A may be be made available in whatever thicknesses and quantities that are necessary to adjust the width of a given blind to a given opening. Obviously, the brackets must overlap the ends of the head rails far enough to adequately support the head rail and blinds, while accomodating as many spacers as are necessary to fill the space between the blinds. Since standard blinds are available in 1 inch increments, at least one half inch of spacers should available to be positioned within each mounting bracket. If this is not enough, longer mounting brackets, or longer head rails, can be provided.

The pressure necessary to hold a standard venetian blind will depend on its type and length, and the number and weight of the slats. For larger and heavier blinds, more pressure will be needed and can easily be applied. The size and shape of the cam, and the length and strength of the lever arm, can, obviously, control the pressure against the jambs of the window frames.

The surface of the end plate is also important. It may be knurled or scored to provide more friction, as shown in FIGS. 1, 2, 3, and 5. It may even have a sandpaper-like surface to provide a more-secure mounting. However, such surfaces may bite into and mar the surface of the window jamb. A rubber or vinyl layer or surface, as seen in figure 4, that can conform to the actual surface of the window jamb, and may, inherently, have a non-skid characteristic, might even be stronger, as well as less damaging, and provide a secure mounting.

Contact glues, or adhesives, or the like, could even be used on the ends of the mounting brackets, or the surfaces of the window casements to provide a more secure mounting, as long as they can be released, without significant damage, when the blind is to be moved.

A part of a typical venetian blind is illustrated here to show the operation of this device, but it is obvious that any type of blinds will be applicable here. Mounting brackets for the most popular sizes should be available, but spacers or adapters could adapt a standard mounting bracket to almost any type or size of head rail.

We claim:

1. A device for supporting a venetian blind having a head rail, said device comprising a first mounting bracket having an open end constructed to fit over one end of said head rail; a pivotable shaft extending into said mounting bracket; a lever arm attached to said shaft externally of said first mounting bracket; a cam rigidly and fixedly attached to said shaft within said first mounting bracket; a separate spacer positioned within said first mounting bracket between said cam and said open end of said first mounting bracket, whereby said cam pivots and urges said spacer towards said open end and against said one end of said head rail upon pivoting of said shaft by said lever arm to force said first mounting bracket away from said head rail and against the inside of a jamb of a window frame to hold said venetian blind in place.

2. The device for supporting a venetian blind as in claim 1, further including a second mounting bracket constructed in accordance with said first mounting bracket, said second mounting bracket fitted over another end of said head rail to provide additional pressure against the inside of an opposing jamb of said window frame.

3. The device for supporting a venetian blind as in claim 1, wherein said first mounting bracket includes a closed end opposing said open end, the exterior of said closed end being scored to provide increased friction against the inside of said jamb.

4. The device for supporting a venetian blind as in claim 1, wherein said first mounting bracket includes a closed end opposing said open end, the exterior of said closed end being covered with a resilient material conformable to the surface of the inside of said jamb to provide increased friction and support for said venetian blind.

5. The device for supporting a venetian blind as in claim 1, wherein said first mounting bracket includes a closed end opposing said open end, the exterior of said closed end being covered with a pressure sensitive adhesive to provide increased adhesion to the inside of said jamb and support for said venetian blind.

6. The device for supporting a venetian blind as in claim 1, wherein the cross-sectional shape of said open end of said first mounting bracket corresponds to the cross-sectional shape of said one end of said head rail.

7. A mounting bracket for releasably securing a head rail of a venetian blind to the inside of a jamb of a window frame, said mounting bracket comprising a housing having an open end constructed to receive one end of said head rail; a cam pivotably supported within said housing; pivoting means attached to said cam and being accessible from outside said housing for pivoting said cam; and a separate spacer positioned within said housing between said cam and said open end of said mounting bracket, whereby pivoting of said cam by said pivoting means urges said spacer towards said open end and against said one end of said head rail to force said housing against the inside of said jamb of said window frame to hold said venetian blind thereat.

8. The mounting bracket as in claim 7, wherein said housing includes a closed end opposing said open end, the exterior of said closed end being scored to provide increased friction against the inside of said jamb.

9. The mounting bracket as in claim 7, wherein said housing includes a closed end opposing said open end, the exterior of said closed end being covered with a resilient material conformable to the surface of the inside of said jamb to provide increased friction and support for said venetian blind.

10. The mounting bracket as in claim 7, wherein said housing includes a closed end opposing said open end, the exterior of said closed end being covered with a pressure sensitive adhesive to provide increased adhesion to the inside of said jamb and support for said venetian blind.

11. The mounting bracket as in claim 7, wherein the cross-sectional shape of said open end of said housing corresponds to the cross-sectional shape of said one end of said head rail.

* * * * *